United States Patent [19]

Waters, Jr.

[11] 4,423,944

[45] Jan. 3, 1984

[54] VERTICAL ROTARY PHOTOGRAPHIC PROCESSOR

[76] Inventor: John M. Waters, Jr., P.O. Box 10392, Tallahassee, Fla. 32302

[21] Appl. No.: 302,825

[22] Filed: Sep. 16, 1981

[51] Int. Cl.[3] ..... G03D 3/04

[52] U.S. Cl. ..... 354/299; 354/312; 354/323; 354/330; 366/247

[58] Field of Search ..... 354/299, 312, 313, 316, 354/323, 329, 330, 324, 328; 366/138, 245, 247, 249, 251

[56] References Cited

U.S. PATENT DOCUMENTS

| | | | |
|---|---|---|---|
| 3,595,158 | 7/1971 | Long | 354/307 |
| 3,677,163 | 7/1972 | Porter | 354/307 |
| 3,703,860 | 11/1972 | Wilkinson | 354/299 |
| 3,792,651 | 2/1974 | Banks | 354/330 |
| 4,005,463 | 1/1977 | Kowalski | 354/329 |
| 4,169,671 | 10/1979 | Culler | 354/312 |
| 4,219,269 | 8/1980 | Bernhardt | 354/329 |
| 4,248,514 | 2/1981 | Watkins | 354/299 |
| 4,277,159 | 7/1981 | Descotes | 354/312 |
| 4,346,979 | 8/1982 | Faubert | 354/329 |

FOREIGN PATENT DOCUMENTS

| | | | |
|---|---|---|---|
| 538820 | 7/1959 | Belgium | 354/329 |

*Primary Examiner*—A. A. Mathews

[57] ABSTRACT

Apparatus and method for processing and treating sheets and rolls of photographic materials. Sheets are placed within a first cylindrical container and also within and outside of second cylindrical containers which coaxially fit within the first container such that a plurality of concentric sheet-mounting surfaces are formed; whereby, several different sheets of materials may be simultaneously processed and treated. A rotatable shaft is cooperatively mounted with the first container to provide for rotatably mounting the second containers and also reels loaded with films. The shaft mounts with the containers and reels along their common central axes such that when the shaft is rotated, the second container can be axially rotated and likewise, the reels can be rotated. The rotation described provides for circulation of fluids relative to the materials. A light-tight cap cooperatively fits with the first container and provides vents for passage of fluids and gases into and out of the inner chambers of the first and second containers, which are in fluid-communication with each other. At the opposite end from the cap, in the containers, additional vents are placed to cooperate with those in the cap. The apparatus provides a carrier for materials which can move the materials through stepped processing and treatment fluids. A plurality of fluids can be contained in tanks which can be temperature-controlled by an external surrounding temperature-regulated water jacket. Means are provided for washing materials in parts of the apparatus.

13 Claims, 14 Drawing Figures

FIG.13
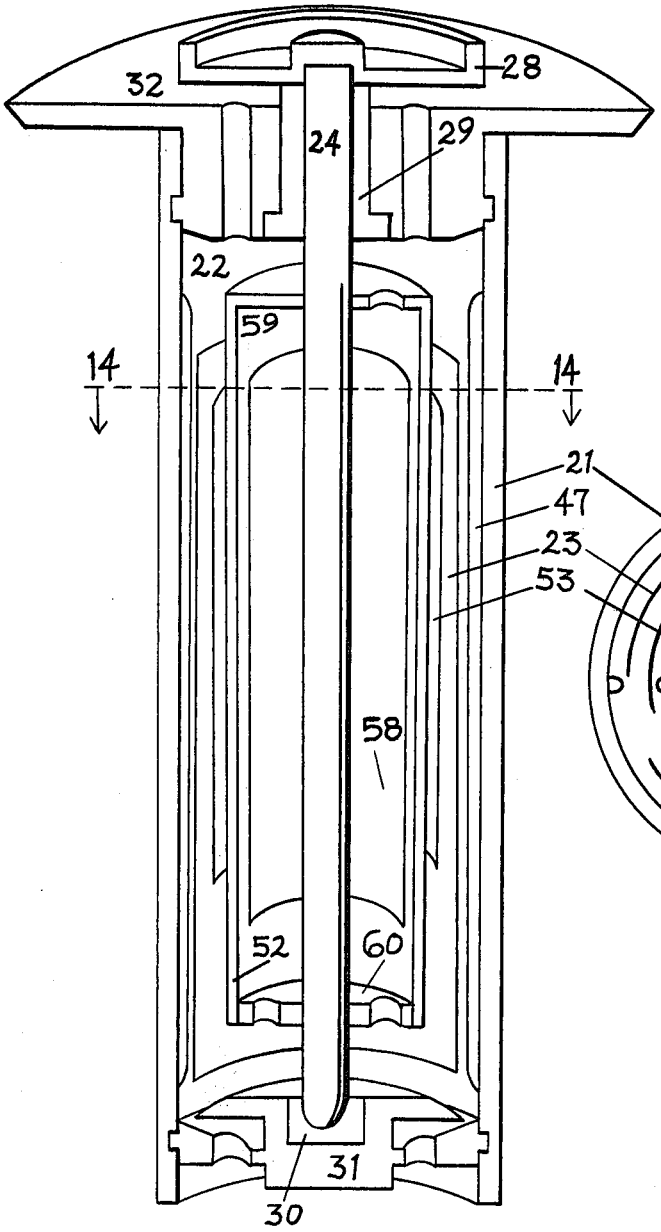
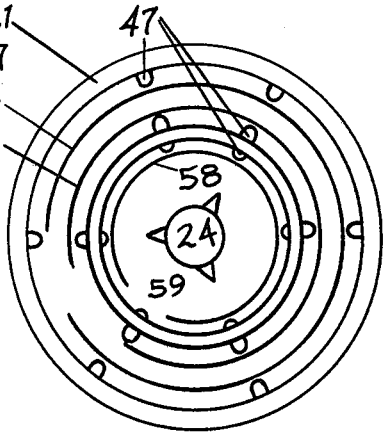
FIG.14

VERTICAL ROTARY PHOTOGRAPHIC PROCESSOR

BACKGROUND OF THE PRESENT INVENTION

Heretofore, apparatus for treating and processing sensitized photographic materials by users of relatively small volumes of multiple types of materials, such as may be found in many industrial, clinical, educational, technical, graphic arts, photojournalistic, hobbiest, and experimental photographic processing laboratories, has generally required different apparatus types as well as different processes. The need for a signal apparatus to provide for treating and processing a plurality of types of materials has long existed in these laboratories, and it was within this background that the present invention was conceived, invented and developed.

SUMMARY

The present invention provides an apparatus for successively treating and processing photographic materials of a wide variety of types, where it is recognized that patterns of fluid circulation with respect to the sensitized surfaces of materials is important and where it is also recognized that certain fluids require such special treatment as gas introduction and temperature regulation.

In accordance with other features of the present invention, it is further recognized that user contact with the fluids is minimized and the apparatus is operative in normal light, once loaded in darkness or suitable safelight.

Various other features of the apparatus and method of the present invention will become obvious to those skilled in the art upon reading the disclosures set forth herein.

BRIEF DESCRIPTION OF THE DRAWINGS

Referring now to the four sheets of drawings, which only show limited examples of apparatus in accordance with the present invention used in the description of method in accordance with the present invention:

FIG. 12 is a schematic illustrating one example of a set up of a plurality of fluids and a rinse, providing for the present invention to be cooperatively operative with;

FIG. 13 is a vertical cross section view taken along the midline of an example second receptacle and a second processing chamber accessary for rotating second and third sheets in the first and second receptacles;

FIG. 14 is a horizontal cross section view taken along line 14—14 of FIG. 13;

Figure 1:
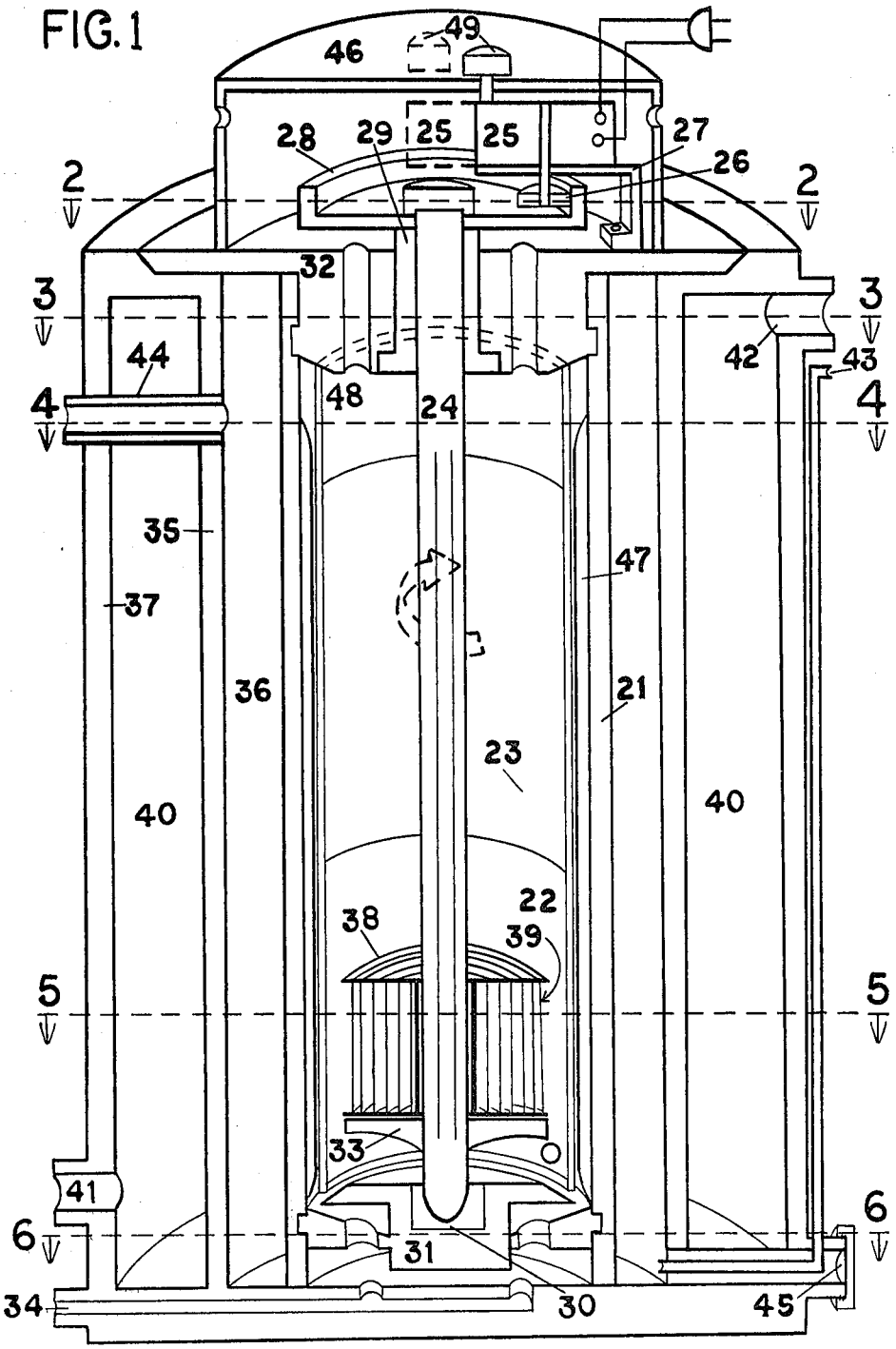
FIG. 1 is an illustration in perspective, in vertical cross section through the midline of an apparatus in accordance with the present invention.

In describing the preferred embodiment of the invention illustrated in the drawings, specific terminology will be resorted to for sake of clarity; however, it is not intended to be limited to the specific terms so selected and it is to be understood that each specific term includes all technical equivalents which operate in a similar manner to accomplish a similar purpose.

DETAILED DESCRIPTION

Now referring to FIG. 1, 21 can be a light-tight normally vertical cylindrical first receptacle, defining and forming a first processing chamber 22. The first processing chamber can be adapted to successively receive and contain a plurality of photographic treatment and processing fluids, sensitized photographic materials, with various parts of the preferred embodiment of the inventive idea to be described herewith. 22 can be made light-tight by fitting a light-tight vented closing bottom means 31 cooperatively with 21, and likewise also fitting a light-tight vented enclosing top means 32, cooperatively with 21. 31 can also provide a means for mounting a lower bearing means 30, and 32 can likewise also provide a means for mounting an upper bearing means 29, bearings 29 and 30 cooperating to provide a means for rotatably mounting a circulation means 24 along the line of the centralmost vertical axis of 22.

Now referring to 24, the circulation means can include a deformed cylindrical shaft having a plurality of vertically-oriented vanes running along its outermost surface, and when 24 is rotated, 24 can provide means for directly circulating treatment and processing fluids contained in 22 horizontally toward first sheets of sensitized materials 23, where 23 can be retained along or nearly along the innermost surface of 21 more or less concentrically therewith. FIGS. 3,4,5, and 6 show various cross sections of FIG. 1 and illustrate the concentric spatial relationships of 21,22,24,29, and other parts of the preferred embodiment described herewith.

Figure 2:
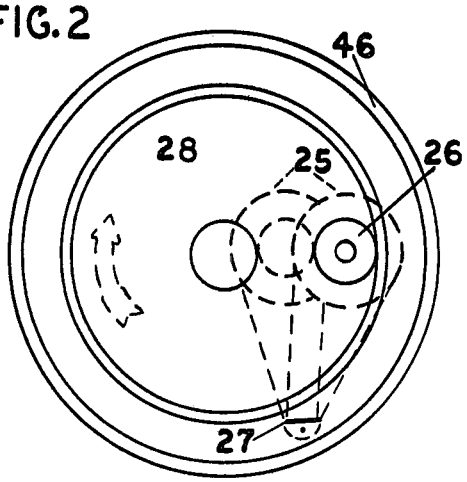
FIG. 2 is a horizontal cross section view taken along line 2—2 of FIG. 1, illustrating means for changing the rotation speed of the shaft.
Figure 3:
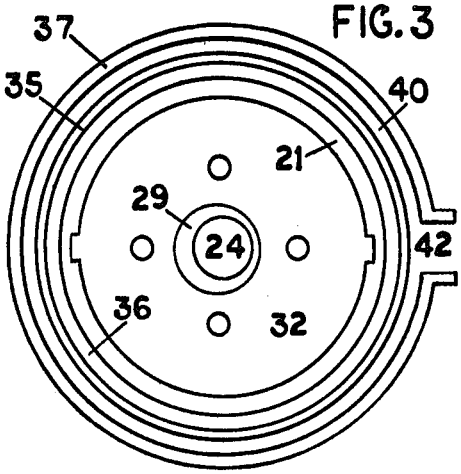
FIG. 3 is a horizontal cross section view taken along line 3—3 of FIG. 1, illustrating the arrangement of the various receptacles for retaining fluids and materials and the water jacket and shaft.

Now referring to FIGS. 1 and 2, a rotation means 25, preferably including an electric motor adapted to operate on 115-volts or less, can be cooperatively connected with 24 by a connecting means, including a driving wheel 26 and a double-surfaced driven wheel 28, where 26 is disposed to frictionally engage with 28 along either of the two running surfaces of 28. Further considering the assembly of 25,27,28, and 24, a positioning means for so engaging 26 with 28 can include a pivotable mounting bracket 27 with a protective cover 46 and a holding means 49. Bracket 27 can be mounted between 25 and 32, providing means for so positioning 25 such that 26 can transmit rotation from 25 to either of the two running surfaces of 28, and 46 can cooperate with 49 for holding 25 in either of said two positions. 49 can include a threaded stud being attached to 25 or to 27, the stud extending externally from 46 where a thumb screw can be cooperatively attached with the stud, the thumb screw providing means for anchoring the stud with cover 46 to so position 25,26, and 27 with respect to 28. Cover 46 also can provide cooperating gas venting means, the venting means of 46 and 32 providing means for equalizing the gas pressures inside of 22 (and other parts of the embodiment described herein) with the surrounding atmospheric pressure where the apparatus can be used.

Figure 5:
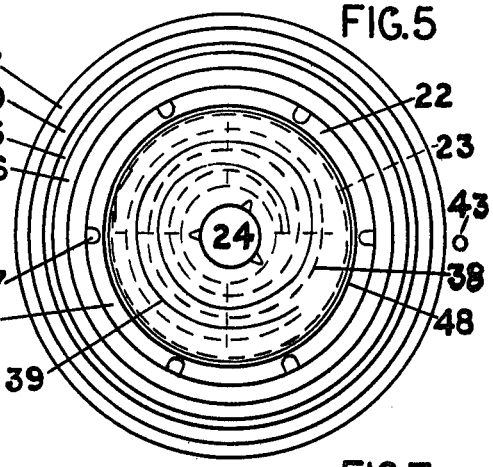
FIG. 5 is a horizontal cross section view taken along line 5—5 of FIG. 1, illustrating the arrangement of various receptacles and retained nonnrotating sheets with respect to retained rotatable reels and film spirals.

Now referring to FIGS. 1, and 5, further considering 24, the circulation means can also be adapted to rotatably retain a plurality of film-strip-retaining-and-positioning reels, 38, where 38 can be disposed for retaining and positioning film strips 39 spirally with 38 and about 24 and within 22. A retainer means 33 can be included to so rotatably retain 38 and 39 in cooperation with 24, 33 providing a frictional connection between the bottom one of a plurality of frictionally-connecting reels 38, and circulation means 24.

Figure 8:
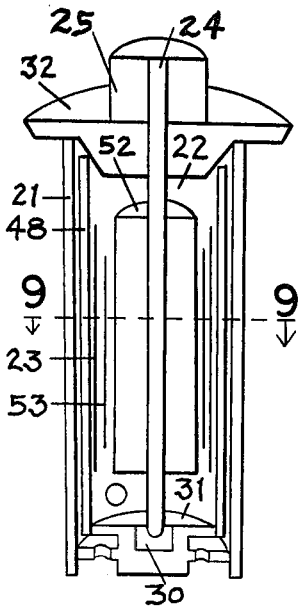
FIG. 8 is a vertical cross section view taken along the midline of an example apparatus illustrating an accessory fluid displacing cylindrical means attached with a circulation means and illustrating planes for retaining first and second sheets within the first processing chamber.

Now referring to FIG. 8, and further considering 24, the circulation means can also be adapted to rotatably cooperate with an accessory detachable cylindrical second receptacle means 52, including a cylinder adapted to fit about 24 within 22, means 52 can provide a means for retaining second sheets of sensitized materials 53 annularly along or nearly along the vertical axis of the outer surface of 52 and submergibly within fluids in 22. Now referring to 52 as illustrated in FIG. 13, 52 can also include a cylinder defining and forming a second processing chamber 59, the chamber being provided with access means 60. Means 60 can be vented for the flow of fluids and gases into and out of 59 at the lower end of 52. Means for venting gases into and out of 59 can be provided at the upper end of 52. The second processing chamber 59, in cooperation with 52,60, and 24 can provide a means for annularly retaining third sheets of materials 58, within chamber 59 where chamber 59 can be adapted to also contain fluids entering 59 through the vents of 60 and from 22 thereto. 52 can be intermittently rotated by 24, and the rotation can provide for relative circulation of the lfuids within 22 and 59 with respect to 23,53, and 58.

The preferred methods and means for so retaining sheets 23 in cooperation with 21 within 22, and 58 in cooperation with 52 and 59 now to be described; where 23 and 58 have sufficient rigidity and resiliency, when submerged in treatment and processing fluids, so as to more or less annularly retain themselves along or nearly along the inner surfaces of 21 and 52 in chambers 22 and 59 respectively, where 23 and 58 can be rolled up, placed in each of said chambers, and then allowed to unroll therein, 23 and 58 can thus provide their own means for so retaining themselves as described; however, where 23 and 58 lacks sufficient rigidity to so be annularly retainable, an accessory backing sheet 48, can provide a means for so retianing 23 and 58. 48 can, by way of example, include a flexible sheet of fluid-impervious material having sufficient rigidity to hold a sheet 23 or 58 and itself within chambers 22 and 59 respectively. Both 23 and 58, when so positioned, either alone or with 48, can having their sensitized surfaces facing inwardly towards the direction of 24 when so retained. Further considering 48, sheets can be retainable therewith by forming 48 to have a plurality of cooperating flaps and grooves along one surface where said sheets can be therewith retained by said flaps and grooves being adapted to retain said sheets along their marginal edges. Further, the spacing between said grooves and flaps can be so spaced as to provide means for retaining a plurality of standard-sized sheets. Odd-sized sheets can also be retained by sections of adhesive tape, of a type compatible with the fluids and materials, being commonly attached with 48 and the margins of said sheets.

Figure 9:
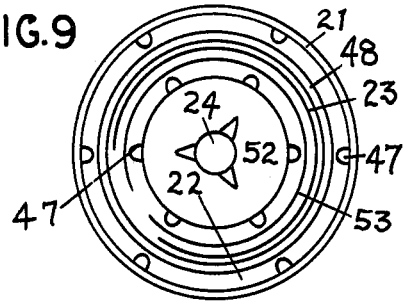
FIG. 9 is a horizontal cross section view taken along line 9—9 of FIG. 8.
Figure 11:
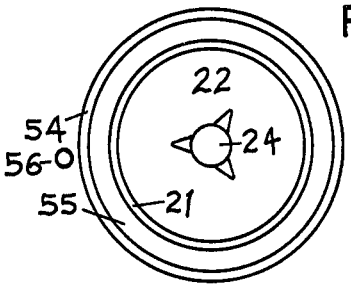
FIG. 11 is a horizontal cross section view taken along line II—II of FIG. 10.

Now referring to the methods and means for retaining second sheets 53 along the exterior surface of 52, as illustrated in FIG. 9: the exterior surface of 52 can be formed with a plurality of vertically-oriented flaps and grooves adapted to marginally retain sheets 53 along outer surfaces of 52 & 48 and likewise can also include use of said adhesive tape sections. Sheets so retained annularly about 52 can be positioned with their sensitized surfaces facing outwardly from 52, towards 21 and within 22.

Now further considering the inner surfaces of 21 and 52, and likwise the outer surface of 52, as illustrated in FIG. 14, where the inner surface of 21 and outer surface of 52 can face towards each other and where the inner surface of 52 faces inwradly towards 24, there can preferably be formed with said surfaces a plurality of vertically-oriented spacer means 47, including a plurality of narrow projecting ridges, in cooperation with said inner surfaces of 21 and 52, and said outer surface of 52. Means 47 can thus provide for a plurality of spaces betwen the nonsensitized back surfaces of sheets 23, 53, and 58 and said inner surface of 21, outer surface of 52, and inner surface of 52 respectively. Said spaces can provide a plurality of channels for rinsing fluids to flow through, along the back (nonsensitized) sides of said sheets, this providing means for removing traces of treatment and processing fluids from the back as well as from the fronts of said sheets when rinsed in a manner to be described herein. The spaces formed by 47 can also prevent quantities of said fluids from being trapped between said sheets and said receptacle walls by cohesion, where this reduces carryover of fluids from one stepped processing fluid to another.

Further considering the preferred embodiment and method for so retaining sensitized sheets 23,53, and 58 within chambers 22 and 59 for treatment and processing, 23,53, and 58 can be retained along more or less angularly separated concentric vertical planes with respect to each other, and with respect to 21,52, and 24. 21 can be so sized as to provide for 23 to be retainable within 22 simultaneously with 38 and 39, both 23 and 39 being retained and processed within 22.

Referring now to the assembly, in whole and in part, of 21,22,23,24,25,26,27,28,29,30,31,32,33,46, and 49, hereinafter referred to as the "carrier means", said carrier means can provide means and methods for successively submerging a plurality of sensitized materials within a plurality of stepped treatment and processing fluids where a plurality of third receptacles 34 are included, the third receptacles each forming and defining a fluid-containing chamber 36, and each chamber 36 providing for containment of a single stepped treatment and processing fluid, and 36 also being disposed and sized so as to receive at least a part of said carrier means, and providing means for fluid contained in 36 of 35 to flow into 22, and from 22 into 59 including said vents of 31 in cooperation with said vents of 59,32,60 & 52, when said carrier means is lowered into 36, therewtih providing for submergence of said retained sensitized materials within said carrier means within said fluid. As fluids so enter 22 and 59, said upper vents of 32 and 59 and said vents in cover 46 can cooperate in providing for equalization of gas pressures within 22 and 59 with respect to the surrounding atmospheric gas pressure where the apparatus and method can be used. Likewise, when said carrier means can be lifted out from 36, gravity can cause fluids in 59 and 22 to cooperatively discharge outwardly from 59 and 22, through the vents of 60 and 31, back into 36. As said fluids drain from 22 and 59, gases can flow through the vents of 46,32 and 52 so as to equalize gas pressure within 22 and 59 with the gas pressure of the surrounding atmosphere.

Figure 6:
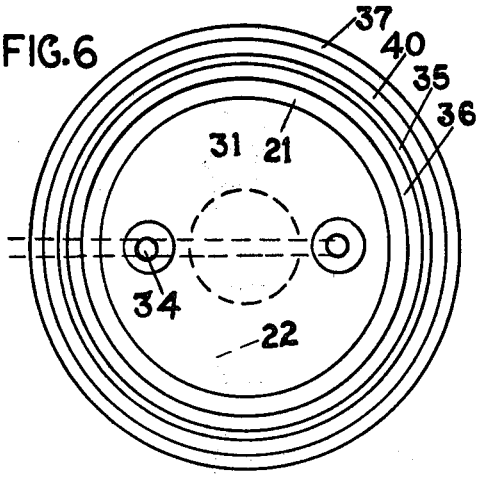
FIG. 6 is a horizontal cross section view taken along line 6—6 of FIG. 1, illustrating various receptacles and a means for introducing gases and fluids to the first and second processing chambers.

Further considering 35 and 36, as illustrated in FIGS. 1 and 6, a gas delivery means 34 can provide means for injection of pressurized gases, into said carrier means and said fluids within 36, where it is desirable for said gas treatment of the fluids and where it is likewise desirable for causing a random agitation and circulation of said fluids with respect to said sensitized surfaces of said materials. Gas delivery mean 34, by way of example, can include a channel having at least one orifice entering into 36 and providing for gases to enter said fluids at the lower end of 36, preferably near a point directly below where said vents of 31 are positioned when said carrier means is positioned within 36. Means 34 can also include a means for connecting the channel to a pressurized gas delivery line, the gas line connecting to a source of pressurized gas, including an air pump, where air is desirable, and including to a pressurized gastank where gases other than air are desirable.

Referring now to FIGS. 1,3,4,5, and 6, and further considering said fluids contained in 36, the temperature of the fluids can be disposed to be regulatable by means including a fourth receptacle 37, the fourth receptacle being adapted to closely fit with 36 such that a water jacket chabmer 40 can be made physically-separated from chamber 36, preferably by structuring 35 as their common wall, and 36 being of a thermally-conductive material, and further providing means for regulating the temperature of said fluids within 40, this providing means, by heat conductance through 35, for regulating the temperatures of said fluids within 36. Jacket 40, iln cooperation with 37 can include a cooperating inlet means 41, and a cooperating outlet means 43;41 and 43 providing means for connecting said water in 40 with a circulating water system providing for said temperature regulation.

Figure 4:
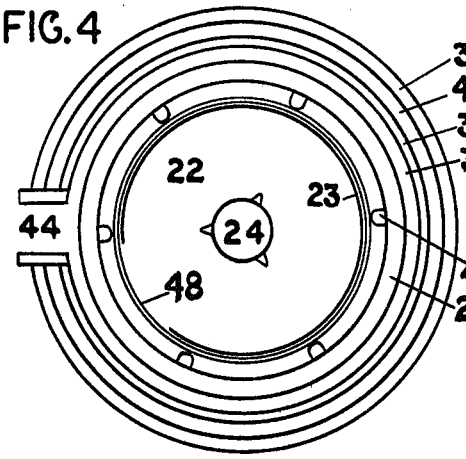
FIG. 4 is a horizontal cross section view taken along line 4—4 of FIG. 1, illustrating the arrangement of the various receptacles and means for retaining nonrotating sheets within the first processing chamber.

Further referring to FIGS. 1 and 4, a processing-fluid replinishment means 43 can provide a means for replinishing used fluids within 36, where 43 can include a fluid-delivery conduit providing means for delivery of predetermined quantities of fresh replinishment fluids to the inside bottom of 36. A fluid overflow means 44 can also be provided, 44 being adapted to maintain a desirable maximum upper level of fluids within 36, and consequently within 22 and within 59. Means 44 can also provide means for connectably discharging overflow effluent into disposal systems and recycling systems. Also, 35 can be fitted with a fluid discharge means 45, 45 preferably being placed along one side of 35 at the bottom of 36, 45 providing means for discharging fluids from 36 at containment levels below 44.

Figure 10:
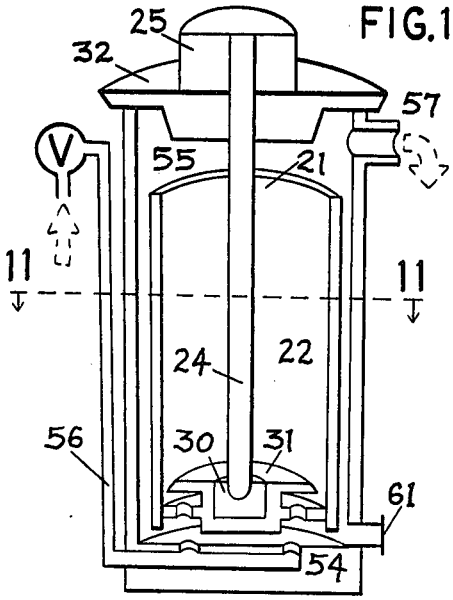
FIG. 10 is a vertical cross section view taken along the midline of an example rinsing tank for use with the present invention in a processing-line set up.

Now referring to FIG. 10, a fifth receptable means 54, forming and defining a rinsing-mixing chamber 55, can provide means for submersing said carrier means in a rinsing fluid bath, where receptacle 54 can include a cooperating rinsing-fluid delivery line 56, 56 being connectable to a source of rinsing fluids, including water, and can also include a cooperating outlet means 57 providing means for discharging overflow of said rinsing fluids from 55, 57 providing for discharged, used rinsing fluids to be disposed of, where 57 can connect with a disposal means. V along 56 represents a controlling valve, including a mixing valve dispsed to deliver water at predetermined temperatures. Further considering the preferred embodiment of said fifth receptacle, chamber 55 can also be adapted for use as a mixing chamber for mixing and preparing predetermined quantities of said treatment and processing fluids where they may require mixing the various compounds forming said fluids, and where the compounds can include water. A mixed-fluid discharge means 61 can be included near the lowermost bottom end of chamber 55 to provide a means for discharge of said mixed fluids from 55 to specific chambers 36 of the apparatus and to storage vessels. With a cooperating use of the assembly of 24,25,26,27,28,29,32, and 49, as illustrated in FIG. 1 and as illustrated in part in FIG. 10, 24 can be disposed to be rotatable within chamber 55, and providing for said water at a predetermined temperature, as delivered to 55 by 56, to rise within 55 to a predetermined level, and to be mixable with said compounds by 24 when 24 is rotated.

Figure 7:
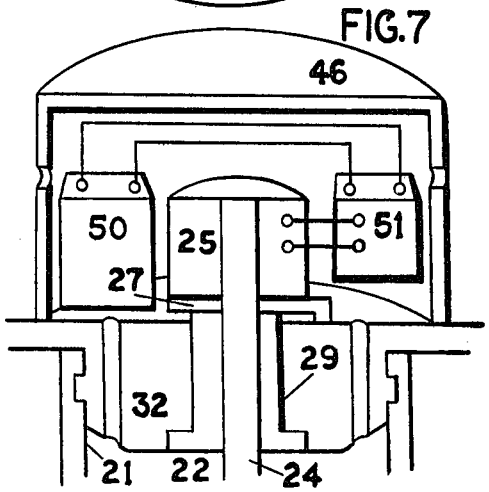
FIG. 7 is a vertical sectional view taken along the midline of a modified example of the present invention, illustrating a directly connected motor and shaft and a battery and timer switch and audio signal oscillator with respect to the first receptacle and first processing chamber.

Now referring to FIG. 7, the rotation means so disposed for intermittently rotating 24 can also include a modification as illustrated, where 25 can be directly connectable with 24, and where 25 can also be a fractional-horsepower electric motor operative on relatively low voltages, preferably in the range of 6-volts to 24 volts, as can be provided by a compact power supply 50, where 50 can include a rechargable battery disposed to power 25. 50 and 25 can also be cooperatively connected with a compact electrical timing swtich 51, where 51 can include a means providing for 25 to be intermittently rotatable in stepped time sequences and as a preferable embodiment of said timing switch, 51 can also include an audible oscillator means providing a sounding signal at various sequences of time, for example, the time when the user needs to change the fluids in contact with the materials from one step to the next. Power means 50 can also include a battery of photovoltaic cells, said cells being externally connectable with 25 where desirable, as when the apparatus is used in remote locations.

Figure 12:
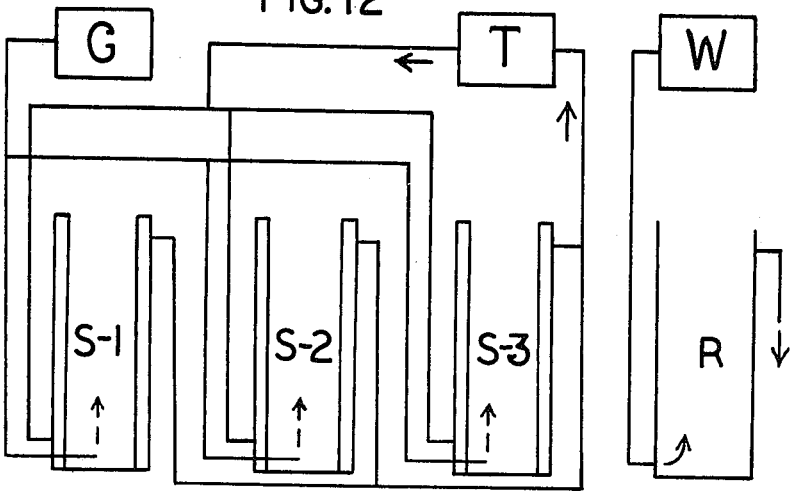

FIG. 12 is a schematic representation, where S-1, S-2, and S-3 represent a plurality of fluids as may be provided with a plurality of 36 and its described connecting parts; R represents a rinsing fluid as may be contained in 55, G represents a source of pressurized gas, as may connect with 34; T represents a circulating water temperature-regulation unit as may connect with 41 and 42; and W represents a pressurized or gravity flow source of water at predetermined temperatures as may connect with 56 and 57. In FIG. 12, crossing lines do not connect.

Now considering other details of the embodiment of the inventive idea, and the method for using, where compactness of the apparatus and a minimum of parts is desirable, the invention can be made workable to process sensitized materials with as few parts as may be provided by the combination of 35,36,32,24,25, and preferably, including 26,27, 46,49,45,33, and 38, where this combination can provide for treatment and processing first sheets 23 & films 39, where 35 can be used with 36 to retain sheets 23 annularly along the inner surface of 35, within 36, in the manner described for retaining sheets 23 within 22 along 21. 32 can be made to form a light-tight fit with 35 when the sensitized materials are within chamber 36. This embodiment of the inventive idea can provide for using the invention in normal light, except during loading of the sensitized material therein and when disconnecting 32 and 35 so as to discharge and fill 36 successively with a plurality of stepped treatment and processing fluids at a predetermined temperature in predetermined quantities.

Now referring to FIG. 13 and considering in particular a preferred structural form of 52, where 59 is formed within 52: as a modification, 59 can be disposed to be made closeable by providing an accessory detachable cylindrical slidably-fitting plug adapted to displace the greater volume from said 59, this providing for 52 to displace and cause said fluids to rise upwards within 22, this providing means for submerging sheets with lower quantities of said fluids. Said plug can preferably be formed of a material having a specific gravity great enough to prevent said carrier means from floating out of 35, as could be the case where 59 was filled with a gas. A plurality of cooperating plugs fitting with and closing the upper vent means of 59 and the lower vent means of 60 can be used to further close 59.

Now further considering the means for positioning sheets 23, 53, and 58: receptacle 21 can be sized to provide means for retaining relatively larger-sized sheets, while the inner surface of 52 could be sized to provide means for retaining relatively smaller-sized sheets, and the outer surface of 52 can be sized to provide means for mounting relatively mid-sized sheets, this arrangement providing for said carrier means to retain three different standard sizes of sheets, for example.

Now considering the cooperation of means 37,40,41, and 42, with respect to 35 and 36, a single 37,40,41, and 42 could provide a common water jacket 40 about a plurality of 35 and 36. Also, where a water jacket is not desirable, for example as when the apparatus can be used in a very compact embodiment, fluids requiring heating can be heated by such heat sources as fire or solar radiation prior to their containment within 22 and 59 where suitable containers are provided.

Now considering various features, advantages and modes of operation of the preferred embodiment, the preferred vertical orientation of said carrier means and columns of fluids in 36 provides advantages, including: providing a relatively small fluid surface area to air surface ratio by forming the volume of fluids in a relatively narrow column, this reducing the amount of fluid surface exposure with atmospheric oxygen, where this is advantageous, and further by providing a decreased area of the surface of the fluids where they can be affected by the ambient temperature of atmospheric air such that there would be resulting changes of temperature occuring with respect to the temperature of said fluids.

The preferred embodiment of the invention can have advantages by providing for larger quantities of replinishable bulk fluids, rather than smaller disposable quantities of fluids, to be used more economically. Where the volume of fluid in 36 is relatively greater, more calories of heat can be stored, and thus less temperature depletion from equalization occurs when the carrier means, at a temperature different than said fluids, is so placed therein, this assisting in the maintenance of more stable processing temperatures where that can be desirable.

Further considering said vertical orientation, less horizontal space is required for processing said sheet materials of given sizes where they can be vertically and annularly retained than where they can be horizontally retained. Also, where electrical power is unavailable, a vertical orientation provides for the carrier means to be "dipped and dunked" to provide a workable circulation means of said fluids with respect to said materials, and likewise where this particular method of circulation is desirable for particular materials and processes.

As a further consideration of 47, where 38 and 39 are rotated within said fluids within 22, and where 23 is absent, 47 can act as a resistance to the horizontal flow of said column of fluid in 22, when 38 and 39 are rotated as described. This can provide for increasing the relative circulation of 39 with respect to said fluids, where said relatively greater circulation is desirable. Also considering the effect of rotating 39 within said fluids within 22, 39 can act as a rotating screw, this causing the relative circulation of the fluids with respect to 39 to be increased.

Where a plurality of 34,35,36,37,40,41,42,45,43, and 44 is provided, this forming a stepped processing line, the line can be oriented to custom fit particular available spaces, as well as providing for a correct number of steps for a particular process. The preferred embodiment also has the advantage of being connectable with a common temperature-controlling unit for regulating their common circulating water jacket. Where the temperatures of various processes are the same, especially, the preferred embodiment provides means for incorporating a plurality of processes controllable by a single temperature-controlling means.

Generally considering the method of using the invention in a photographic laboratory, the use of an automatic circulation means, as provided, can be advantageous by freeing the operator to perform other operations in cooperation with the use of the invention as described. Further, the carrier means, when used in steps, minimizes handling of the materials and reduces contact with said fluids, where said fluids may be poisonous to the operator.

Now concerning the materials from which the various parts can be made, where the parts are in contact with said fluids, they can be made from moisture-impervious materials resistant to chemical reaction with said fluids.

It will be recognized that the foregoing embodiments of the invention and method for using are but examples of an apparatus and method within the scope of the present invention and that various other modifications will occur to those skilled in the art upon reading the disclosure set forth hereinbefore.

The invention claimed is:

1. An apparatus is successively processing and treating a plurality of sensitized photographic materials in a plurality of predetermined quantities of stepped photographic processing and treatment fluids, said apparatus being light-tight when loaded with said materials, and further, said apparatus being adaptable to cooperate with means for regulating the temperature of said fluids within a desirable range, comprising, (a) a vertically-oriented first receptacle means defining and forming a first processing chamber, said first receptacle also being cylindrical in shape, and said first chamber adapted to submersibly retain first sheets of said sensitized materials vertically and annularly therein with respect to said first receptacle and said first sheets being normally positioned with their sensitized surfaces facing outwardly with respect to said first receptacle's innermost wall;

(b) means cooperating with said first receptacle providing for rotatably mounting a circulation means centrally within said first chamber along the central vertical axis thereof, said circulation means comprising a cylindrical deformed shaft, and said circulation means adapted to directly circulate said fluids horizontally with respect to said sensitized surfaces of said first sheets within said first chamber when said circulation means is rotated;

(c) means providing for intermittently rotating said circulation means cooperating with said first receptacle;

(d) means providing access to said first chamber for loading and unloading sensitized materials and various cooperating parts of the apparatus;

(e) cooperating means providing for said fluids to enter said first chamber such that said fluids completely submerge said materials therein, and providing for discharge of said fluids from said first chamber;

(f) means providing for gases to enter into and exit therefrom said first chamber.

2. An apparatus as in claim 1, and further, said vertically-oriented first receptacle means also being adapted to disconnect from said means providing for rotatably mounted said circulation means with said first receptacle.

3. An apparatus as in claim 1, and further, said first receptacle having a plurality of longitudinal spacing means, comprising a plurality of raised ridges, such that said ridges keep said first sheets of sensitized materials spaced slightly away from said innermost wall of said first receptacle, this providing a plurality of channels for a flowing rinse fluid to flow through said chamber and remove traces of processing fluids from both sides of said materials, and where the first receptacle can be disconnected from said means for rotatably mounting said circulation means.

4. An apparatus as in claim 1, and said means providing for intermittently rotating said circulation means comprising, (a) an electric motor operable on a compact power supply;

(b) a compact power supply including an electric battery;

(c) a timing device to intermittently connect said power supply and said electric motor; and said timing device also incorporating an audible signal oscillator providing for signaling predetermined stepped time sequences.

5. An apparatus for successively processing and treating a plurality of sensitized photographic materials in a plurality of predetermined quantities of stepped photographic processing and treatment fluids, said apparatus being light-tight when loaded with said materials and further, said apparatus being adaptable to cooperate with means for regulating the temperature of said fluids within a desirable range where that is desirable, comprising, (a) a vertically-oriented first receptacle means defining and forming a first processing chamber, said first receptacle also being cylindrical in shape, and said first chamber adapted to submersibly retain first sheets of said sensitized materials vertically and annularly therein with respect to said first receptacle and said first sheets being normally positioned with their sensitized surfaces facing outwardly with respect to said first receptacle's innermost wall;

(b) means cooperating with said first receptacle providing for rotatably mounting a circulation means centrally within said first chamber along the central vertical axis thereof, said circulation means comprising a cylindrical deformed shaft, and said circulation means adapted to directly circulate said fluids horizontally with respect to said sensitized surfaces of said first sheets within said first chamber when said circulation means is rotated;

(c) means providing for intermittently rotating said circulation means cooperating with said first receptacle;

(d) means providing access to said first chamber for loading and unloading sensitized materials and various cooperating parts of the apparatus;

(e) cooperating means providing for said fluids to enter said first chamber such that said fluids completely submerge said materials therein, and providing for discharge of said fluids from said first chamber;

(f) means providing for gases to enter into and exit therefrom said first chamber;

and further, said circulation means rotatable retaining a second receptacle means within said first processing chamber, said second receptacle means comprising, (g) a generally cylindrical drum adapted to fit cooperatively with said circulation means and being rotatable simultaneously therewith, said second receptacle providing means for retaining second sheets of sensitized materials along the outer surface of said second receptacle with their sensitized surfaces facing outwardly from said second receptacle towards said first receptacle, said second sheets being submersible within said fluids within said first processing chamber when so retained, said circulation means also cooperating with said second receptacles for directly circulating said second sheets within said fluids in said first chamber when said circulation means is rotated, and providing for said fluids to simultaneously circulate with respect to said sensitized surfaces of said first sheets, and said second receptacle means also disposed for displacing a quantity of said fluids within said first chamber, providing for the relative level of said fluids to rise proportionately to the fluid-displacement volume of said second receptacle relative to the fluid volume with said first chamber.

6. An apparatus as in claim 5, and further, said vertically-oriented first and second receptacles being adapted to disconnect from said means providing for rotatably mounting said circulation means and said first and second chambers with said circulation means.

7. An apparatus as in claim 6, and further, said vertically-oriented first receptacle and said second receptacle having a plurality of longitudinal spacing means, comprising a plurality of raised ridges, such that said ridges keep said first and second sheets spaced slightly away from said receptacles, this providing a plurality of channels for a flowing rinse fluid to flow through for removing traces of processing fluids from the both sides of said sheets of sensitized materials, when said materials are inside said first chamber, and where said first and second receptacles can be disconnected from said means for rotatably mounting said circulation means.

8. An apparatus for successively processing and treating a plurality of sensitized photographic materials in a plurality of predetermined quantities of stepped photographic processing and treatment fluids, said apparatus being light-tight when loaded with said materials, and further, said apparatus being adaptable to cooperate with means for regulating the temperature of said fluids within a desirable range, comprising, (a) a vertically-oriented first receptacle means defining and forming a first processing chamber, said first receptacle also being cylindrical in shape, and said first chamber adapted to submersibly retain first sheets of said sensitized materials vertically and annularly therein with respect to said first receptacle and said first sheets being normally positioned with their sensitized surfaces facing outwardly with respect to said first receptacle's innermost wall;

(b) means cooperating with said first receptacle providing for rotatably mounting a circulation means centrally within said first chamber along the central vertical axis thereof, said circulation means comprising a cylindrical deformed shaft, and said circulation means adapted to directly circulate said fluids horizontally with respect to said sensitized surfaces of said first sheets within said first chamber when said circulation means is rotated;

(c) means providing for intermittently rotating said circulation means cooperating with said first receptacle;

(d) means providing access to said first chamber for loading and unloading sensitized materials and various cooperating parts of the apparatus;

(e) cooperating means providing for said fluids to enter said first chamber such that said fluids completely submerge said materials therein, and providing for discharge of said fluids from said first chamber;

(f) means providing for gases to enter into and exit therefrom said first chamber, and further, said circulation means rotatably retaining a second receptacle means within said processing chamber, and said second receptacle means comprising, (g) a generally cylindrical drum adapted to fit cooperatively with said circulation means and being rotatable therewith within said first processing chamber, and said second receptacle defining and forming a second processing chamber, said second chamber being in fluid-communication with said first chamber and providing means for annularly retaining third sheets of said sensitized materials within said second processing chamber with their sensitized surfaces facing outwardly from the inner wall of said second receptacle, and said third sheets being submersible within said fluids when so retained, and said first and second receptacles so relatively sized and coaxially positioned as to provide for said first and third sheets to be simultaneously processed and treated;

(h) means providing access to said second chamber for loading and unloading said third sheets therein;

(i) cooperating venting means providing for portions of said fluids within said first chamber to enter into and discharge from said second chamber;

(j) cooperating venting means providing for gases to enter into and discharge from said second chamber.

9. An apparatus as in claim 8, and further, said vertically-oriented first receptacle means and said second receptacle means being adapted to disconnect from said means providing for rotatably mounting said circulation means.

10. An apparatus as in claim 8, and further, said vertically-oriented first receptacle and said second receptacle having a plurality of longitudinal spacing means, comprising a plurality of raised ridges, such that said ridges keep said first and third sheets spaced slightly away from said receptacles, this providing a plurality of channels for a flowing rinse fluid to flow through for removing traces of processing fluids from the both sides of said sheets of sensitized materials, when said materials are inside said first and second chambers, and where said first and second receptacles can be disconnected from said means for rotatably mounting said circulation means.

11. An apparatus for successively processing and treating a plurality of sensitized photographic materials in a plurality of predetermined quantities of stepped photographic processing and treatment fluids, said apparatus being light-tight when loaded with said materials, and further, said apparatus being adaptable to cooperate with means for regulating the temperature of said fluids within a desirable range, comprising, (a) a vertically-oriented first receptacle means defining and forming a first processing chamber, said first receptacle also being cylindrical in shape, and said first chamber adapted to submersibly retain first sheets of said sensitized materials vertically and annularly therein with respect to said first receptacle and said first sheets being normally positioned with their sensitized surfaces facing outwardly with respect to said first receptacle's innermost wall;

(b) means cooperating with said first receptacle providing for rotatably mounting a circulation means centrally within said first chamber along the central vertical axis thereof, said circulation means comprising a cylindrical deformed shaft, and said circulation means adapted to directly circulate said fluids horizontally with respect to said sensitized surfaces of said first sheets within said first chamber when said circulation means is rotated;

(c) means providing for intermittently rotating said circulation means cooperating with said first receptacle;

(d) means providing access to said first chamber for loading and unloading sensitized materials and various cooperating parts of the apparatus;

(e) cooperating means providing for said fluids to enter said first chamber such that said fluids completely submerge said materials therein, and providing for discharge of said fluids from said first chamber;

(f) means providing for gases to enter into and exit therefrom said first chamber, and further, said circulation means also retaining a plurality of films within said first chamber submersibly within said fluids, the films being so retained along outwardly-spiraling planes, and said films being so retained by means comprising, (g) a plurality of frictionally-connectable reels adapted to retain said films in spirals, said reels also being adapted to connect with said circulation means and directly circulate said films with respect to said fluids when said circulation means is rotated.

12. An apparatus as in claim 11, and said means providing for said circulation means to be intermittently rotatable also provides for circulating said fluids at a plurality of different speeds, thereby changing the rate of circulation of said fluids and thus the chemical speed of said processing and treatments.

13. An apparatus as in claim 11, and further, said vertically-oriented first receptacle means also being adapted to disconnect from said means providing for rotatably mounting said circulation means.

* * * * *